US012017834B2

(12) United States Patent
Huffer

(10) Patent No.: US 12,017,834 B2
(45) Date of Patent: Jun. 25, 2024

(54) MEMBRANE LID WITH INTEGRATED TWO-STAGE TAB SYSTEM

(71) Applicant: SONOCO DEVELOPMENT, INC., Hartsville, SC (US)

(72) Inventor: Scott William Huffer, Hartsville, SC (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 99 days.

(21) Appl. No.: 17/697,237

(22) Filed: Mar. 17, 2022

(65) Prior Publication Data

US 2022/0204237 A1 Jun. 30, 2022

Related U.S. Application Data

(62) Division of application No. 16/561,253, filed on Sep. 5, 2019, now Pat. No. 11,299,334.

(51) Int. Cl.

| | |
|---|---|
| ***B65D 77/20*** | (2006.01) |
| ***B65D 51/20*** | (2006.01) |
| ***B65D 65/40*** | (2006.01) |

(52) U.S. Cl.

CPC ..... *B65D 77/2032* (2013.01); *B65D 51/20* (2013.01); *B65D 65/40* (2013.01); *B65D 2251/0031* (2013.01); *B65D 2251/0071* (2013.01); *B65D 2577/205* (2013.01); *B65D 2577/2091* (2013.01)

(58) Field of Classification Search

CPC ..... B65D 2575/3245; B65D 75/5855; B65D 77/2032; B65D 51/20; B65D 65/40; B65D 2251/0031; B65D 2251/0071; B65D 2577/205; B65D 2577/2091; B65D 2577/2041; B65D 77/2056

See application file for complete search history.

(56) References Cited

U.S. PATENT DOCUMENTS

| | | | |
|---|---|---|---|
| 3,335,939 | A | 8/1967 | Robinson, Jr. |
| 3,380,622 | A | 4/1968 | Garavaglia et al. |
| 3,391,849 | A | 7/1968 | Horning |
| 3,441,197 | A | 4/1969 | White |
| 3,659,739 | A | 5/1972 | Luviano et al. |

(Continued)

FOREIGN PATENT DOCUMENTS

| | | | |
|---|---|---|---|
| EP | 1559658 | A2 | 8/2005 |
| EP | 1842792 | A1 | 10/2007 |

OTHER PUBLICATIONS

Xolution Relock Can—Retrieved from: https://www.xolution.com/product/- 2019. (18 pages).

(Continued)

*Primary Examiner* — Kareen K Thomas

(74) *Attorney, Agent, or Firm* — Nelson Mullins Riley & Scarborough LLP

(57) ABSTRACT

The present invention relates to a resealable membrane lid for a container comprising a peelable portion and a removable portion. When the resealable peelable portion is peeled back, the seal onto the container is not disturbed. When the removable portion is removed from the container, the container contents may be accessed. The peelable portion may be resealed onto the container at any point in the process.

8 Claims, 10 Drawing Sheets

(56) References Cited

U.S. PATENT DOCUMENTS

| | | | | |
|---|---|---|---|---|
| 3,817,417 | A * | 6/1974 | Edwards | B65D 77/2024 229/123.1 |
| 3,946,871 | A | 3/1976 | Sturm | |
| 3,952,914 | A | 4/1976 | Vogt | |
| 4,020,969 | A | 5/1977 | Ando | |
| 4,171,084 | A | 10/1979 | Smith | |
| 4,562,936 | A | 1/1986 | Deflander | |
| 4,681,238 | A | 7/1987 | Sanchez | |
| 4,735,335 | A | 4/1988 | Torterotot | |
| 4,858,780 | A | 8/1989 | Odaka et al. | |
| 5,069,355 | A | 12/1991 | Matuszak | |
| 6,085,942 | A * | 7/2000 | Redmond | B65D 77/2052 206/820 |
| 6,193,094 | B1 | 2/2001 | Diamond et al. | |
| 6,196,450 | B1 | 3/2001 | Varadarajan et al. | |
| 6,234,386 | B1 * | 5/2001 | Drummond | B29C 66/028 229/5.5 |
| 6,260,721 | B1 | 7/2001 | Ohmi et al. | |
| 6,264,098 | B1 * | 7/2001 | Drummond | B29C 66/131 229/5.5 |
| 6,302,290 | B1 * | 10/2001 | Engelaere | B65D 77/2096 220/62.12 |
| 6,302,321 | B1 * | 10/2001 | Reese | B65D 77/2044 229/5.5 |
| 6,544,613 | B1 * | 4/2003 | Varadarajan | B65D 77/2032 220/359.3 |
| 6,691,886 | B1 | 2/2004 | Berndt et al. | |
| 6,786,329 | B2 | 9/2004 | Onishi | |
| 6,959,832 | B1 | 11/2005 | Sawada et al. | |
| 7,731,048 | B2 | 6/2010 | Teixeira Alvares et al. | |
| 8,434,635 | B2 | 5/2013 | Wichelhaus | |
| 8,746,483 | B2 | 6/2014 | Sierra-Gomez et al. | |
| 8,746,490 | B2 | 6/2014 | Huffer et al. | |
| 10,273,044 | B2 | 4/2019 | Thielen et al. | |
| 2003/0183540 | A1 * | 10/2003 | Onishi | B65D 43/168 206/205 |
| 2005/0247713 | A1 | 11/2005 | Niederer et al. | |
| 2005/0252952 | A1 * | 11/2005 | Nomula | B65D 3/22 229/5.5 |
| 2006/0201944 | A1 | 9/2006 | Shibasaka et al. | |
| 2009/0134160 | A1 | 5/2009 | Alvares et al. | |
| 2010/0019022 | A1 | 1/2010 | Ryan et al. | |
| 2013/0011527 | A1 | 10/2013 | Nakamura et al. | |
| 2019/0112109 | A1 | 4/2019 | Huffer | |

OTHER PUBLICATIONS

Canadian Patent Application No. 3,006,160, filed May 25, 2018, Canadian Office Action dated Dec. 31, 2019.

International Search Report and Written Opinion dated Oct. 28, 2020 for International Application No. PCT/US2020/043010; 13 pages.

* cited by examiner

MEMBRANE LID WITH INTEGRATED TWO-STAGE TAB SYSTEM

CROSS-REFERENCE TO RELATED APPLICATIONS

This application is a divisional of U.S. patent application Ser. No. 16/561,253 filed on Sep. 5, 2019, entitled "MEMBRANE LID WITH INTEGRATED TWO-STAGE TAB SYSTEM", which is incorporated herein in its entirety.

FIELD OF THE INVENTION

The present invention relates generally to membrane peelable lids with an integrated two-stage tab system, containers comprising such membrane lids, and methods for making the same.

SUMMARY OF THE INVENTION

In an embodiment, the invention is directed to a resealable membrane lid for a container comprising: a peelable portion, the peelable portion comprising: a peelable upper layer having an upper surface and a lower surface, a peelable lower layer having an upper surface and a lower surface, and a pressure sensitive adhesive layer adjacent at least a portion of the lower surface of the peelable upper layer and at least a portion of the upper surface of the peelable lower layer, wherein the peelable portion further comprises a central portion and a first pull tab which extends radially from the central portion, and wherein the peelable portion comprises a plurality of score lines which extend at least substantially through the peelable lower layer but do not extend into the peelable upper layer, the score lines comprising: a first score line which is disposed interior of a perimeter of the central portion of the peelable portion, is at least partially circumferential, and defines a peripheral region between the first score line and an edge of the peelable portion, at least one second score line disposed along the perimeter of the central portion of the peelable portion, adjacent the first pull tab, and a third score line which forms the perimeter of a second pull tab; a removable portion, the removable portion comprising: a removable upper layer having an upper surface and a lower surface and a removable lower layer having an upper surface and a lower surface and having a fourth score line disposed circumferentially therethrough, wherein the upper surface of the removable lower layer is affixed to the lower surface of the removable upper layer and the lower surface of the removable lower layer is configured to be sealed to the rim of a container, and a permanent adhesive layer disposed: within the peripheral region, adjacent the removable upper layer and the peelable lower layer, and within at least a portion of the perimeter of the second pull tab, adjacent the removable upper layer and the peelable lower layer.

In another embodiment, the invention is directed to a container having a resealable membrane lid comprising: a container body comprising a bottom wall and at least one upwardly extending sidewall, wherein the at least one sidewall terminates in a rim and wherein the rim defines an open end of the container; and a membrane lid comprising: a peelable portion, the peelable portion comprising: a peelable upper layer having an upper surface and a lower surface, a peelable lower layer having an upper surface and a lower surface, and a pressure sensitive adhesive layer adjacent at least a portion of the lower surface of the peelable upper layer and at least a portion of the upper surface of the peelable lower layer, wherein the peelable portion further comprises a central portion and a first pull tab which extends radially from the central portion, and wherein the peelable portion comprises a plurality of score lines which extend at least substantially through the peelable lower layer but do not extend into the peelable upper layer, the score lines comprising: a first score line which is disposed interior of a perimeter of the central portion of the peelable portion, is at least partially circumferential, and defines a peripheral region between the first score line and an edge of the peelable portion, at least one second score line disposed along the perimeter of the central portion of the peelable portion, adjacent the first pull tab, and a third score line which forms the perimeter of a second pull tab; a removable portion, the removable portion comprising: a removable upper layer having an upper surface and a lower surface and a removable lower layer having an upper surface and a lower surface and having a fourth score line disposed circumferentially therethrough, wherein the lower surface of the removable lower layer is sealed to the rim of the container, wherein the upper surface of the removable lower layer is affixed to the lower surface of the removable upper layer, and a permanent adhesive layer disposed: within the peripheral region, adjacent the peelable lower layer and the removable upper layer, and within a portion of the perimeter of the second pull tab, adjacent the peelable lower layer and the removable upper layer.

In still another embodiment, the invention is directed to a method of manufacturing a flexible membrane lid for a container comprising: providing a peelable upper layer and a peelable lower layer in sheet form; applying a pressure sensitive adhesive to at least one of the peelable upper layer and the peelable lower layer; laminating the peelable upper layer to the peelable lower layer to form a first web; scoring the peelable lower layer of the first web to form a plurality of score lines comprising: a first score line which is disposed interior of a perimeter of the central portion of the peelable portion, is at least partially circumferential, and defines a peripheral region between the first score line and an edge of the peelable portion, at least one second score line disposed at least partially along the perimeter of the central portion of the lid, and a third score line which forms a perimeter of a first pull tab; pattern applying a permanent adhesive to the peelable lower layer within the peripheral region and within a portion of the perimeter of the first pull tab; providing a removable upper layer and a removable lower layer which are affixed to form a second web; laminating the peelable lower layer of the first web to the removable upper layer of the second web, via the permanent adhesive, to form a third web; scoring the removable lower layer of the second web to define: a perimeter of a removable portion of the lid, and a fourth score line which is disposed radially interior of first score line and is circumferential; cutting the third web through at least the peelable upper layer and peelable lower layer to form a perimeter of the peelable portion of the lid, wherein the perimeter of the peelable portion of the lid includes a second pull tab which: extends radially outwardly from a central portion of the lid, and is disposed adjacent the at least one second score line; providing a container comprising a container body which comprises a bottom wall and at least one upwardly extending sidewall, wherein the at least one sidewall terminates in a rim and wherein the rim defines an open end of the container; and sealing the membrane lid to the rim of the container, over the open end.

In an embodiment, the invention is directed to a container system comprising a resealable membrane lid sealed to a rim of a container, wherein the membrane lid comprises a peelable portion and a removable portion which are permanently adhered about their perimeters, permanently adhered in the location of an internal pull tab which is integral to the peelable portion, and other than in the locations of the permanent adhesive, adhesive-free between the peelable portion and the removable portion, wherein the peelable portion comprises an external pull tab and is at least partially peelable and resealable onto the rim of the container via a pressure sensitive adhesive layer, and wherein the removable portion is permanently adhered to the rim of the container and a portion of the removable portion, defined by score lines disposed therein, must be removed in order to access the contents of the container.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1A:
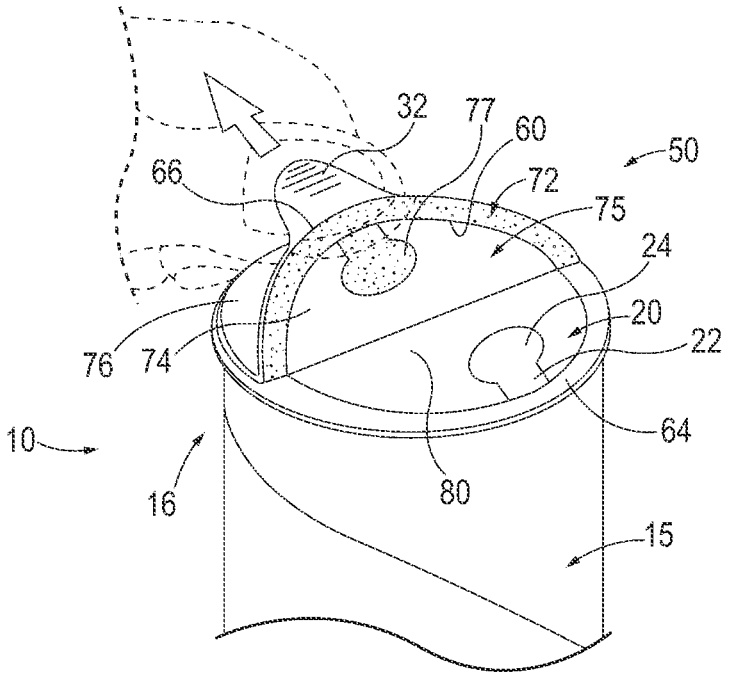
FIGS. 1A-1B are perspective views of a container and lid in accordance with one embodiment of the invention, in various stages of opening.

Elements illustrated in the figures are not necessarily drawn to scale. Repeat use of reference characters in the present specification and drawings is intended to represent the same or analogous features or elements of the invention.

DETAILED DESCRIPTION OF PREFERRED EMBODIMENTS

Reference will now be made in detail to embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Food and drink products, such as coffee, spices, sugar, cookies, crackers, snacks, as well as non-food items, such as powders, cleaners, and outdoor chemicals are often packaged in resealable containers, such that the component inside the container can be partially used and then the container can be resealed, using a pressure sensitive adhesive ("PSA") or the like, until the next use. In some cases, however, due to the nature of the PSA seal and/or one or more score lines in or adjacent the PSA, the resealable lid may not provide a hermetic seal, may fail to hold a gas flush, or may not provide an oxygen barrier which meets industry requirements. For example, gasses may inadvertently pass through the PSA portions of the reseal.

In other cases, a flexible, peelable membrane may be adhered over an access point into a container, such as one of the container ends. Flexible, peelable membranes may provide a hermetic seal and may also provide a consumer with easy access to the products contained inside by peeling back the membrane. In many cases, the peelable membrane is peeled back and/or removed from the container by the user through use of a tab that is continuous with the membrane. The tab is pulled up or back to peel the membrane away from the rim of the container, revealing the container contents. However, in these embodiments, the membrane is not resealable.

In the present invention, through ingenuity and hard work, the inventor has developed a resealable, flexible membrane lid which also provides a hermetic seal, holds a gas flush, and/or provides an oxygen barrier which meets industry requirements. In an embodiment, the inventive membrane lid has a pull tab which enables a consumer to grasp and peel a peelable portion of the membrane lid at least partially away from the container. The peelable portion of the membrane lid may be resealable onto to the rim, flange, or edge of the container. In an embodiment, peeling away the peelable portion from the container does not provide access to the container contents. Rather, a separate layer may be disposed beneath the peelable portion, between the peelable portion and the container, which blocks access to the container interior. This separate lower layer may be referred to herein as a removable portion.

In an embodiment, the membrane lid additionally comprises at least a second tab which enables the consumer to grasp and peel at least part of the separate removable portion away from the container. In an embodiment, the removable portion may be at least partially torn in removal from the container. The removable portion may be partially or entirely removable from the container. Once partially or entirely removed, the space previously occupied by the removable portion may provide access to the interior of the container. If entirely removed, the removable portion may then be discarded. In an embodiment, the peelable portion of the membrane lid may then be resealed onto the container, if desired. The reseal allows preservation of the container contents.

In an embodiment, the second tab may be disposed within the perimeter of the membrane lid. In an embodiment, the second tab is integral with the peelable portion of the membrane lid. That is, the second tab is part of, comprised of, and/or continuous with at least one layer of the peelable portion. The second tab, in an embodiment, is defined by score lines in at least one layer of the peelable portion.

In use, when the peelable portion is pulled back, the second tab, which is integral with the peelable portion but permanently adhered to the removable portion, may release or separate from the peelable portion and may remain affixed to the removable portion. The second tab, which is then separated from the peelable portion and affixed to the removable portion, may be grasped and pulled to remove at least part of the removable portion from the access point of the container.

The inventive membrane lid provides an integral solution which is easy to manufacture and easy for the consumer to use. In an embodiment, the lidding is hermetic and, once opened, is resealable. The lidding may hold a gas flush and may provide an oxygen barrier which meets industry requirements. Due to the specific layering, configuration, and die cut structure, diffusion of gases from the interior of the container to the exterior of the container may be significantly reduced or eliminated.

Figure 1B:
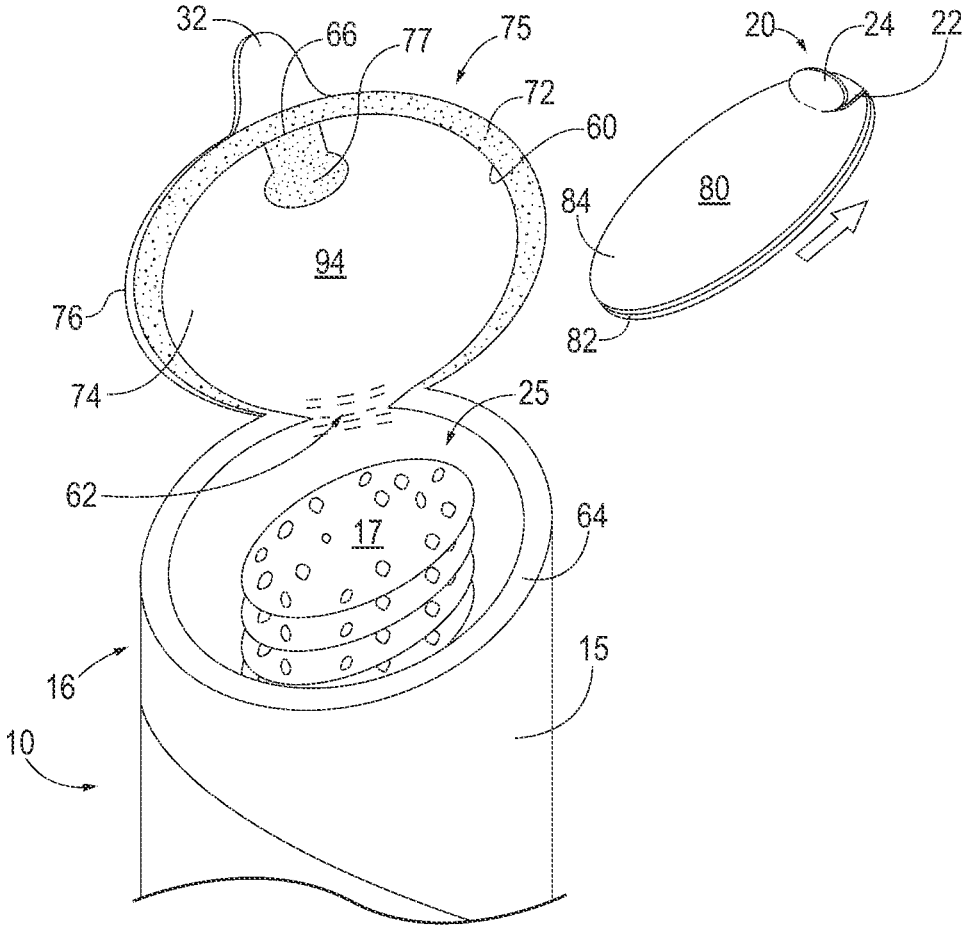

Referring now to the drawings, in FIG. 1A-1B, a container 10 is shown according to an embodiment of the invention. The container 10 may include a body portion 15 having a first end 16 that defines an opening 25 (shown in FIG. 1B) providing access to an interior of the body 15 and the products 17 disposed therein. The container 10 may further include a peelable membrane lid 50 for closing the body 15 to form the container 10. The body 15 may include a rim 35 (shown in FIG. 2) at the first end 16, and the peelable membrane lid 50 may be sealed to the rim 35 to close the container 10.

While the embodiment shown in FIG. 1 is a tubular composite container, it should be understood that any type of container, any container shape, and any container materials could be utilized in the invention. For example, the container may comprise metal, plastic, paper, and/or any other materials known in the art. Likewise, the container is shown as cylindrical, but the container body may be any shape that has at least one sidewall extending upwardly from a base. The container may be cylindrical, tubular, square, rectangular, or any other shape known in the art. The container may be formed in any manner known in the art.

As shown in the figures, the peelable membrane lid 50 may include multiple layers. In some embodiments, the peelable membrane lid 50 may include a peelable portion 75 and a removable portion 80, each of which may comprise one or more layers. In an embodiment, the peelable portion 75 is disposed above the removable portion 80, with respect to the container. In an embodiment, the peelable portion 75 is an exterior layer and the removable portion 80 is an interior layer, with respect to the container. In an embodiment, the peelable portion 75 is adjacent and at least partially adhered to the removable portion 80. In an embodiment, the lower surface of the peelable portion 75 is adjacent and is at least partially adhered to the upper surface of the removable portion 80. In an embodiment, a permanent adhesive is disposed in a pattern between the interface of the lower surface of the peelable portion 75 and the upper surface of the removable portion 80. In an embodiment, the lower surface of the removable portion 80 is permanently adhered to the rim, flange, or edge of the container.

Figure 2A:
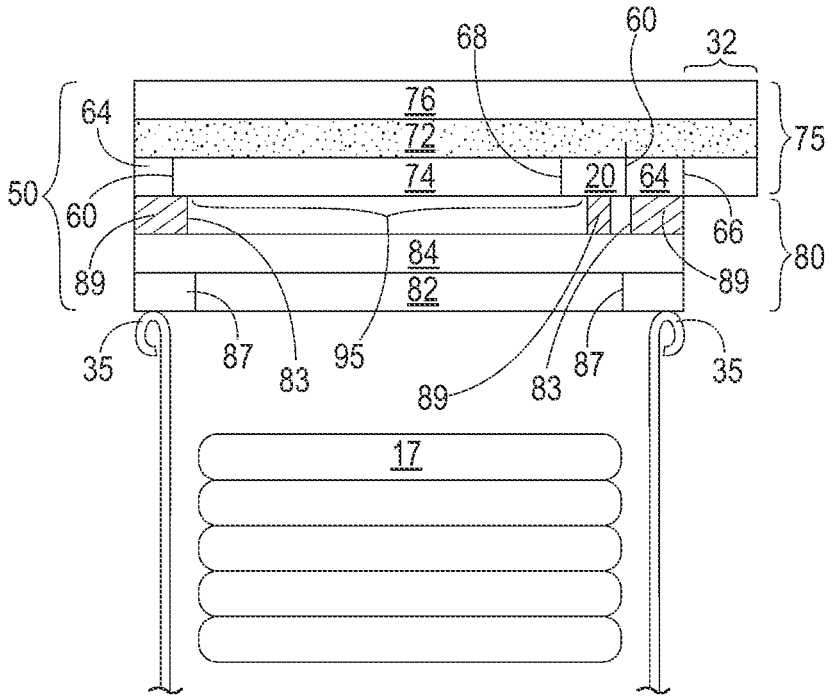
FIGS. 2A-2C are cross-sectional views of a container and lid of the invention in various stages of opening, in accordance with an embodiment of the invention.
Figure 2B:
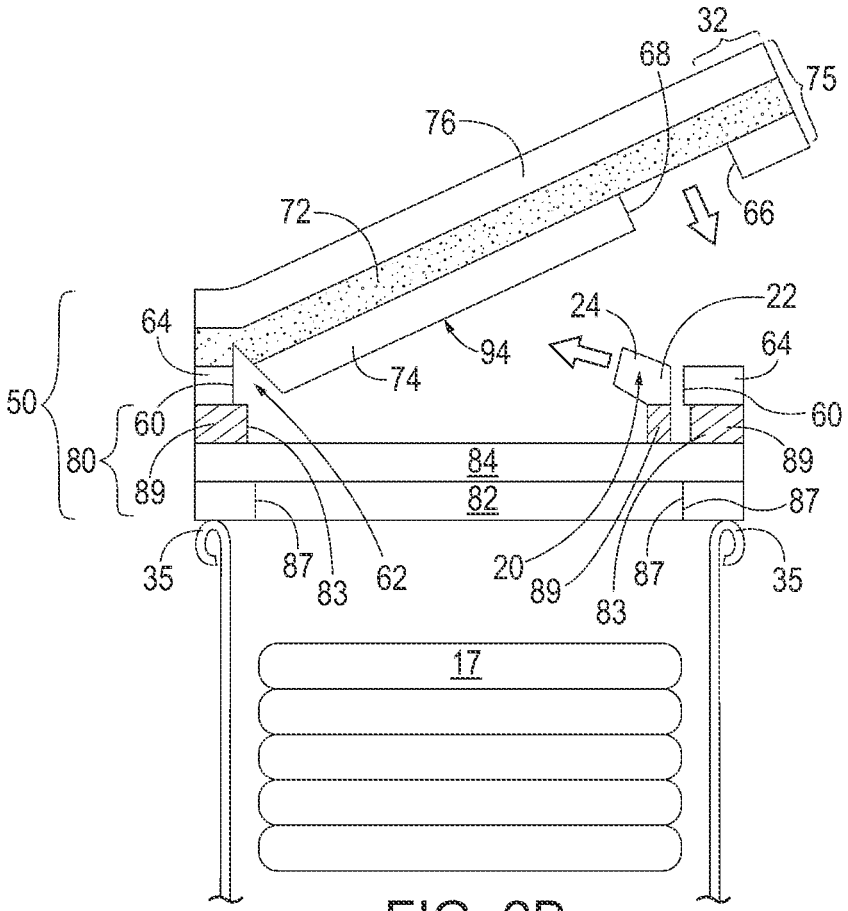
Figure 2C:
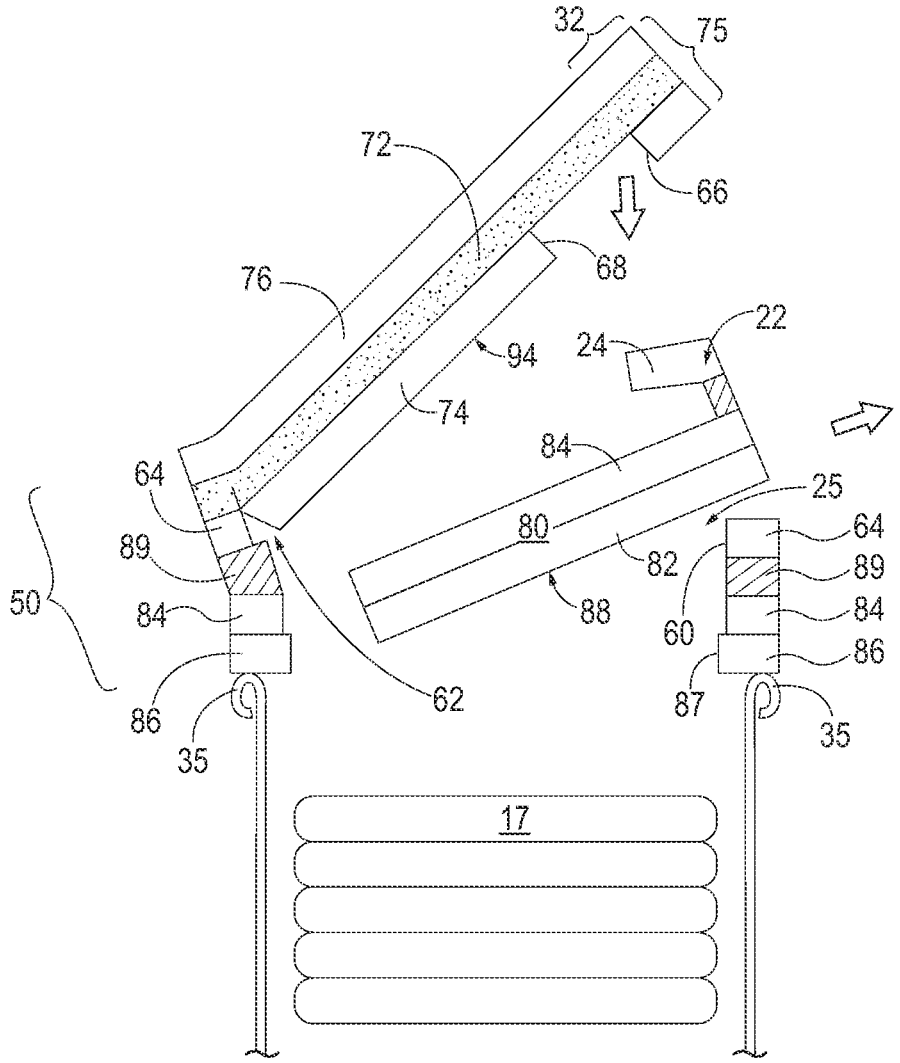

In an embodiment, the peelable portion 75, as shown in FIG. 2A-2C, may comprise two or more layers. The outermost layer of the lid 50 and peelable portion 75 may be referred to herein as a first layer, an upper layer, a peelable upper layer, or a top layer 76. The top layer 76 may comprise a flexible film, a paper, a metalized material, any combination of the same, or may comprise any other material known in the art. The top layer 76 may have printed matter displayed thereon, in an embodiment, such as labeling, logos, nutritional information, instructions, or the like. One or more additional layers may be disposed above or exterior to the top layer 76, in certain embodiments.

In an embodiment, a second layer 74 may be disposed adjacent, and in some embodiments, below, the first layer 76, with respect to the container. The second layer 74 may be referred to herein as a lower layer of the peelable portion or a peelable lower layer. In an embodiment, the second layer 74 is part of the peelable portion 75 of the peelable membrane lid 50. In an embodiment, each of the first layer 74 and the second layer 76 has an upper surface and a lower surface. One or more additional layers may be disposed between the first layer 76 and the second layer 74, in certain embodiments.

In an embodiment, the first layer 76 and the second layer 74 of the peelable portion are adhered together, at least partially, via a PSA layer 72. In this embodiment, the first layer 76 and the second layer 74 may sandwich the PSA layer 72. In an embodiment, the lower surface of the upper layer 76 is at least partially adhered to the upper surface of the lower layer 74. In an embodiment, the PSA layer 72 comprises a pattern which is applied between the layers 74, 76 such that it is disposed at least in line with the rim 35 of the container to which the lid is to be applied. In another embodiment, the PSA layer 72 is applied about the circumference of the lid 50, at least in a peripheral region, between layers 74 and 76. In an embodiment, the peripheral region of the peelable portion corresponds to the location of the rim 35 of the container.

In an embodiment, the PSA layer 72 is also disposed between layers 74 and 76 in the location of a second pull tab, to be discussed in more detail below. In this embodiment, the second pull tab, which is integral with the peelable lower layer 76 and defined by certain score lines, is removably adhered to the peelable upper layer 74. In these embodiments, a stronger or permanent adhesive may be disposed between layers 74 and 76 other than in the areas wherein the PSA is disposed—for example in a central portion of the lid 50, inside the peripheral region and outside the second tab. In other embodiments, the PSA layer 72 is flood coated between the layers 74 and 76. That is, the PSA layer 72 may cover the entire surface of either or both layers 74 and 76, on the interface between the layers. The PSA layer 72 may comprise any PSA known in the art.

The second layer 74 of the lid 50 may comprise a flexible film, a paper, a metalized material, any combination of the same, or may be comprised of any other material known in the art. In an embodiment, the first and second layers 76, 74 of the lid 50 comprise the same materials and in other embodiments, the first and second layers 76, 74 of the lid 50 comprise different materials. For example, layer 76 may comprise paper and layer 74 may comprise a polymeric material, in an embodiment. In an embodiment, at least one of the peelable upper layer 76 and the peelable lower layer 74 comprises a polymeric film. In an embodiment, the first and second layers 76, 74 are coextensive with each other (i.e. they have substantially the same width, length, and/or other dimension) and extend at least to the perimeter of the rim 35 of the container.

In some embodiments, the peelable portion 75 may include a pull tab 32, which may be a radially extending portion of or protrusion from the peelable portion 75 that can be grasped by a user, as depicted in FIG. 1A, and used to peel the peelable portion 75 away from the body 15. Though pull tab 32 is depicted as extending radially from the membrane, it should be understood the that pull tab 32 could be provided in any manner known in the art. For example, pull tab 32 could extend upwardly from peelable portion 75 and/or could be any shape known in the art (square, rectangular, semi-circular, triangular, etc.). In some embodiments, the pull tab 32 may be referred to as an external pull tab. Further, though pull tab 32 is shown as integral with peelable portion 75, pull tab 32 could be a separate element which is adhered to the peelable portion. Similarly, while pull tab 32 is shown as integral with the first layer 76 and the second layer 74, it should be understood that pull tab 32 may be integral with only one of those layers, in an embodiment.

In an embodiment, the peelable lower layer 74 of the peelable portion 75 may be scored or undercut in one or more positions. In an embodiment, the undercuts may extend through the second layer 74 and, optionally, into the PSA layer 72, but preferably not into the first layer 76. In an embodiment, the undercuts result in one or more cut lines in the second layer 74. In an embodiment, the peelable portion 75 comprises a plurality of score lines which extend at least substantially through the peelable lower layer 74 but do not extend into the peelable upper layer 76.

A first cut line 60 may be disposed in a position which aligns with, is adjacent with, or is slightly inside the interior edge (relative to the container) of the rim 35. The first cut line 60 may be disposed circumferentially or substantially circumferentially about the lid 50, sized and configured to substantially align with the interior edge of the rim 35. In an embodiment, the peelable portion 75 comprises a central portion and a first pull tab 32 which extends radially from the central portion. In an embodiment, the first cut line 60 is disposed interior of a perimeter 63 of the central portion of the peelable portion 75. In an embodiment, the first cut line 60 defines an affixed portion 64 of the second layer 74, between cut line 60 and the perimeter 63 of the central portion of the peelable portion 75, which remains affixed to the removable portion 80 and rim 35, while the remainder of the second layer 74 is lifted away from the removable portion 80 and rim 35. In an embodiment, the first cut line 60 is disposed radially interior of the circumferential permanent adhesive 89, discussed below. In an embodiment, the first cut line 60 is disposed radially exterior of the fourth cut line 87, also discussed below.

Figure 5A:
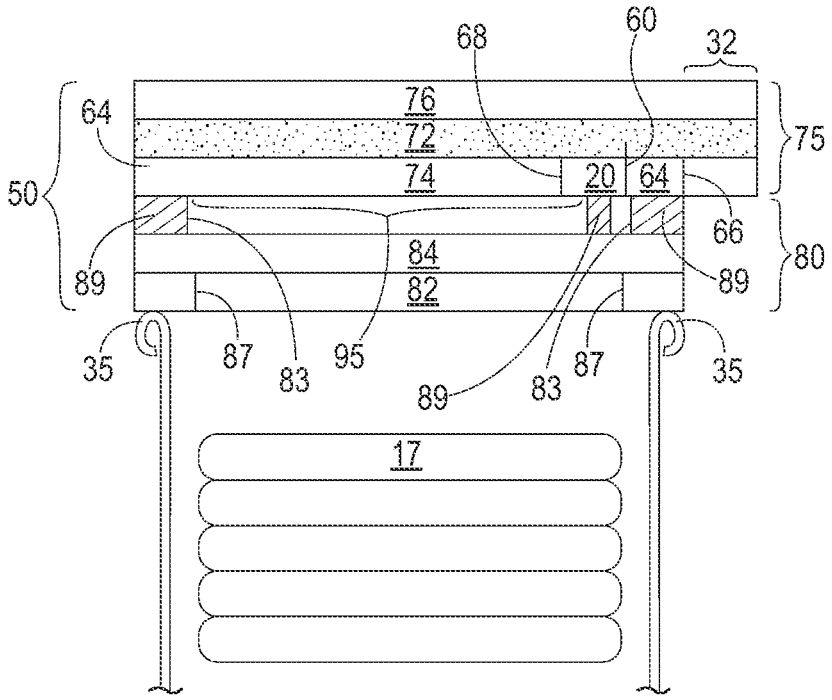
FIGS. 5A-5C are cross-sectional views of a container and lid of the invention in various stages of opening, in accordance with an embodiment of the invention.
Figure 5B:
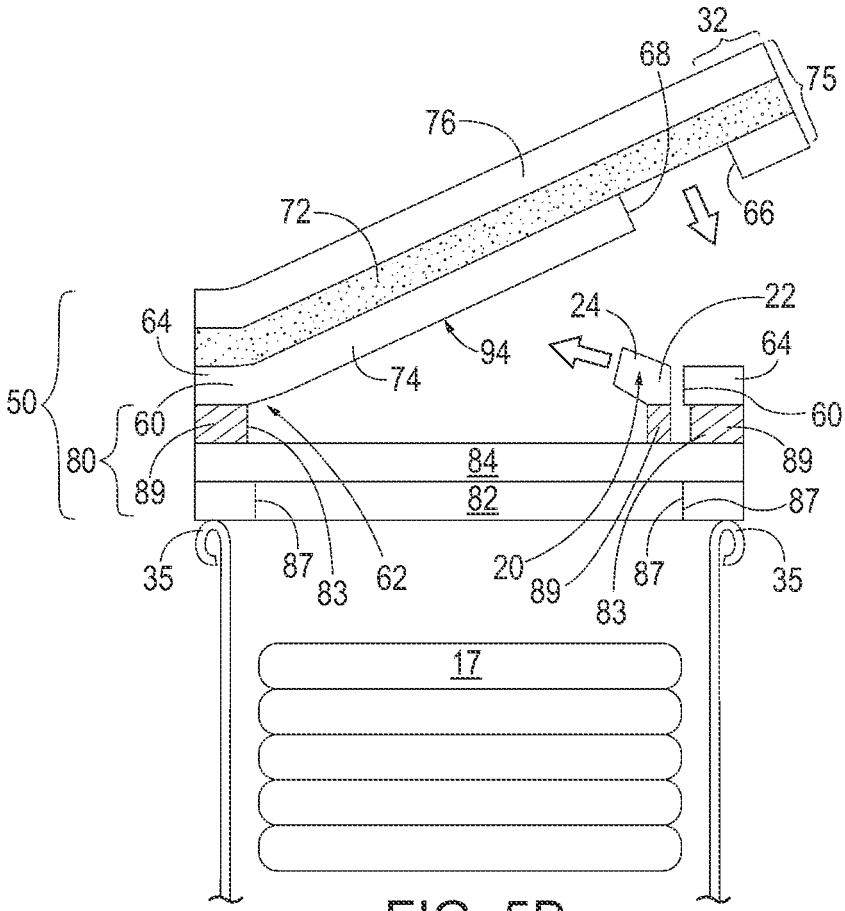
Figure 5C:
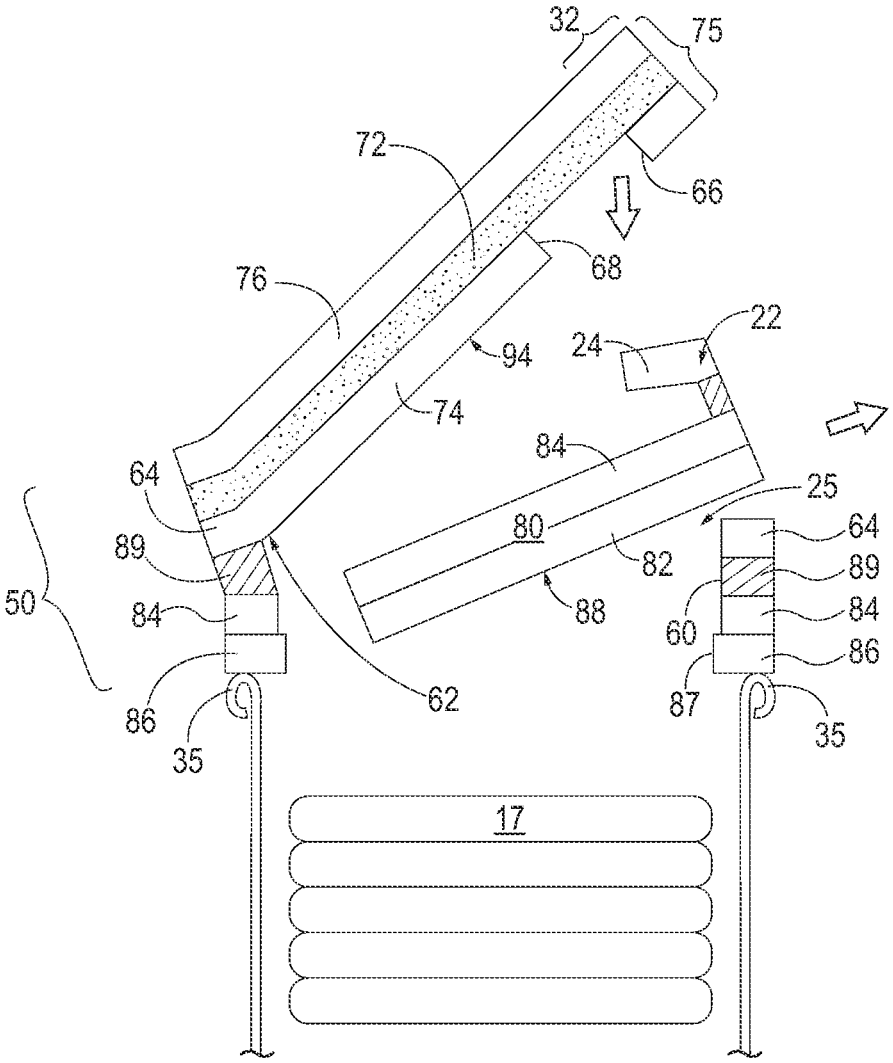

In an embodiment, the first cut line 60 may be at least partially circumferential. In an embodiment, the first cut line 60 is not fully circumferential (see FIGS. 3A and 5). That is, the first cut line 60 may extend partially or substantially, but not fully, about the circumference of the rim 35. In an embodiment, a portion of the second layer 74 is not cut via cut line 60, but is otherwise circumferentially aligned with cut line 60, forming a hinge 62 (shown in FIGS. 1B, 5B, and 5C). In an embodiment, the hinge 62 is disposed between two opposing ends of first cut line 60. In an embodiment, the first cut line 60 ends in two j-hooks, or other mechanisms which would avoid tearing of the film at the end of the first cut line 60.

Figure 6A:
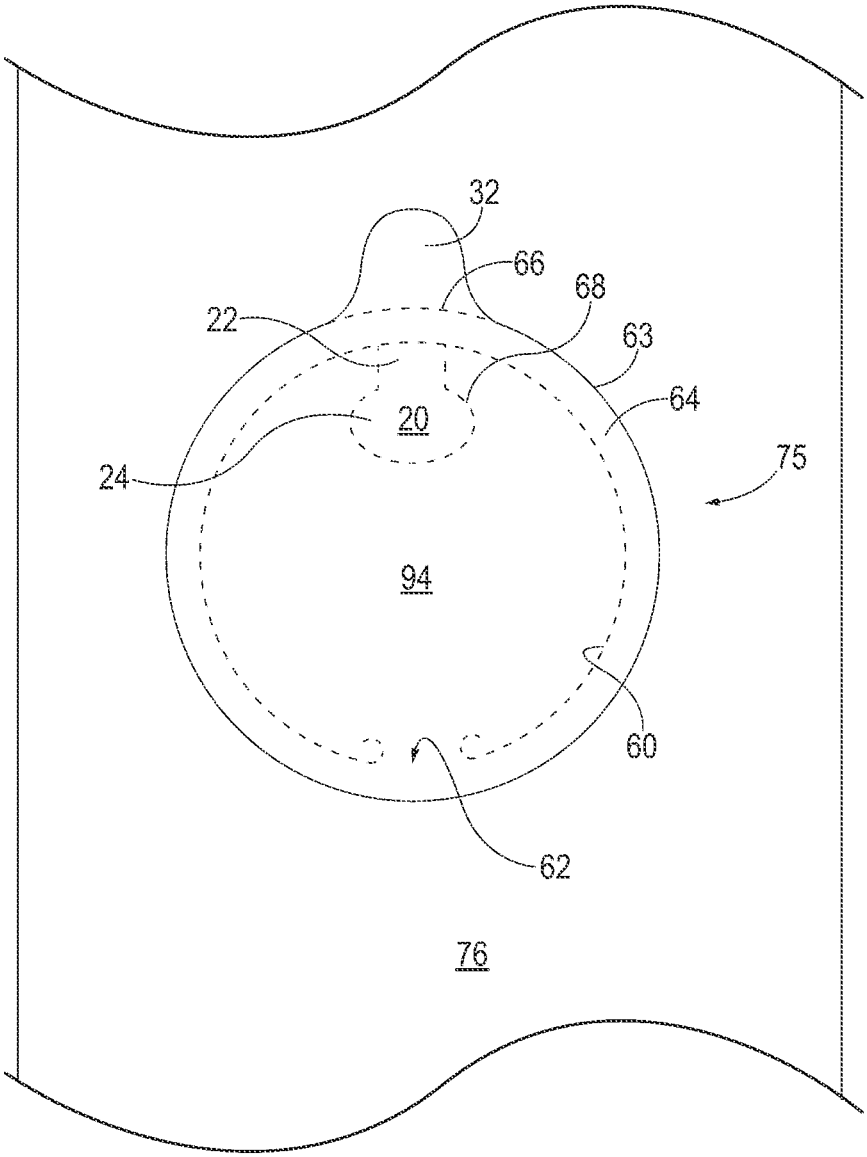
FIG. 6A illustrates a top view of a laminate sheet of the peelable portion of the lid, in accordance with an embodiment of the invention shown in FIGS. 2A-2C.

In another embodiment, however, the first cut line 60 may be fully circumferential (see FIGS. 2 and 6). In this embodiment, central portion of second layer 74 the may completely separate from the affixed portion 64 of the second layer 74. In an embodiment, a hinge 62 may be formed between the top layer 76 and the affixed portion 64 of the second layer 74. Alternatively, in this embodiment, the entire peelable portion 75 may be separable from the container via a splitting of the PSA layer 72. In this embodiment, the peelable portion 75 may be fully removed from the container and, if desired, replaced onto the container via the PSA layer 72.

In an embodiment, the affixed portion 64 of the second layer 74 and the remainder of the second layer 74 (the central portion) are hingedly affixed and movable at the point of the hinge 62. The hinge 62 allows the peelable portion 75 to be peeled away from the container 10 without being fully removed from the container 10. In an embodiment, the affixed portion 64 of the second layer 74 is permanently adhered to at least a portion of the removeable portion 80, to be discussed in greater detail below. In an embodiment, the affixed portion 64 circumvents the perimeter of the rim 35. In an embodiment, the hinge 62 is disposed along the perimeter of the rim 35, opposite the tab 32. That is, the hinge 62 may be disposed on the opposite side of the container from the tab 32.

In an embodiment, the hinge 62 is disposed adjacent to or interior of the inner edge of rim 35. In an embodiment, the hinge 62 is substantially aligned with a portion of the fourth cut line 87 (discussed below) of the removable portion 80. In an embodiment, the hinge 62 is radially exterior the fourth cut line 87 (discussed below) of the removable portion 80. In yet another embodiment, the hinge 62 is substantially aligned with a portion of the perimeter of the upper layer 84 of the removable portion 80.

In an embodiment, the second layer 74 is also undercut to form at least one second cut line 66 (shown in FIGS. 2, 3A, 5, and 6). The second cut line 66 may be disposed adjacent or inwardly (relative to the container) of the tab 32. In an embodiment, the second cut line 66 is disposed along the perimeter of the central portion of the peelable portion, adjacent the first pull tab. The second cut line 66 may be, in an embodiment, disposed adjacent or in line with the exterior or outer edge of the rim 35. The second cut line 66 may allow the portion of second layer 74 disposed in the position of the tab 32 to separate from the remainder of layer 74. While cut line 66 is shown as a single cut line, it should be understood that cut line 66 may comprise a plurality of cut lines which are concentric or parallel, to ensure an easy separation between the tab 32 and the container rim 35.

Due to the adhesive layer 72 between layers 74 and 76, at least in the position of tab 32, the tab 32 may comprise first layer 76, second layer 74, and adhesive layer 72 (shown in FIGS. 2B and 2C). In an embodiment, the pull tab 32 may be grasped by a user, as depicted in FIG. 1, and used to peel the peelable portion 75 away from the container.

In an embodiment, the second layer 74 is additionally undercut to form a third cut line 68. The third cut line 68 may be disposed radially inwardly of the second cut line 66 (relative to the container). The third cut line 68 may be disposed inwardly of the first cut line 60 (relative to the container). The third cut line 68 may be sized and shaped to form an internal or second pull tab 20. In an embodiment, the third cut line 68 may define the perimeter of the second pull tab 20. In an embodiment, the third cut line 68 may be a closed shape. For example, the third cut line 68 may define a rectangle, circle, oval, an irregular shape, or the like. In an embodiment, the third cut line 68 may intersect or be continuous with the first cut line 60 such that the combination of cut line 68 and cut line 60 forms a closed shape.

The internal pull tab 20, in an embodiment, is part of and is integral with the second layer 74. That is, a cut line 68 in the second layer 74 defines the boundaries of the second pull tab 20. The internal tab 20 may be shaped and sized in any manner which is convenient for grasping. In an embodiment, the internal tab 20 may be rectangular, square, half-circular, ovular, or the like. In an embodiment, internal tab 20 comprises a neck portion 22 and a grasping portion 24. In an embodiment, the neck portion 22 of the internal tab 20 may be adjacent the grasping portion. In an embodiment, the neck portion 22 may be disposed closer to the rim 35 than the grasping portion 24, closer to the centerline of the container than the grasping portion 24, or may be disposed in any other position adjacent the grasping portion 24. In an embodiment, the neck portion 22 may be narrower than the grasping portion 24. In an embodiment, the neck portion 22 may of a different shape than the grasping portion 24. The grasping portion 24 may be the portion of the tab which is used to grasp and pull the removable portion 80 away from the container.

In an embodiment, at least a portion of the internal pull tab 20 is permanently adhered to the upper surface of the removable portion 80. In a particular embodiment, a portion of the internal pull tab 20 may be permanently adhered to the upper surface of the foil layer 84. In this embodiment, the neck portion 22 may be permanently adhered to the removable portion 80 (i.e. the foil layer 84). In this embodiment, when the grasping portion 24 is grasped and pulled away from the container, the permanent adhesive between the tab 20 and the removable portion 80 may cause the tab 20 to remain affixed to the removable portion 80, thereby allowing removal of at least a part of the removable portion. In an embodiment, the grasping and pulling of the tab 20 tears at least a portion of the foil layer 84, to be explained more fully below.

Figure 3A:
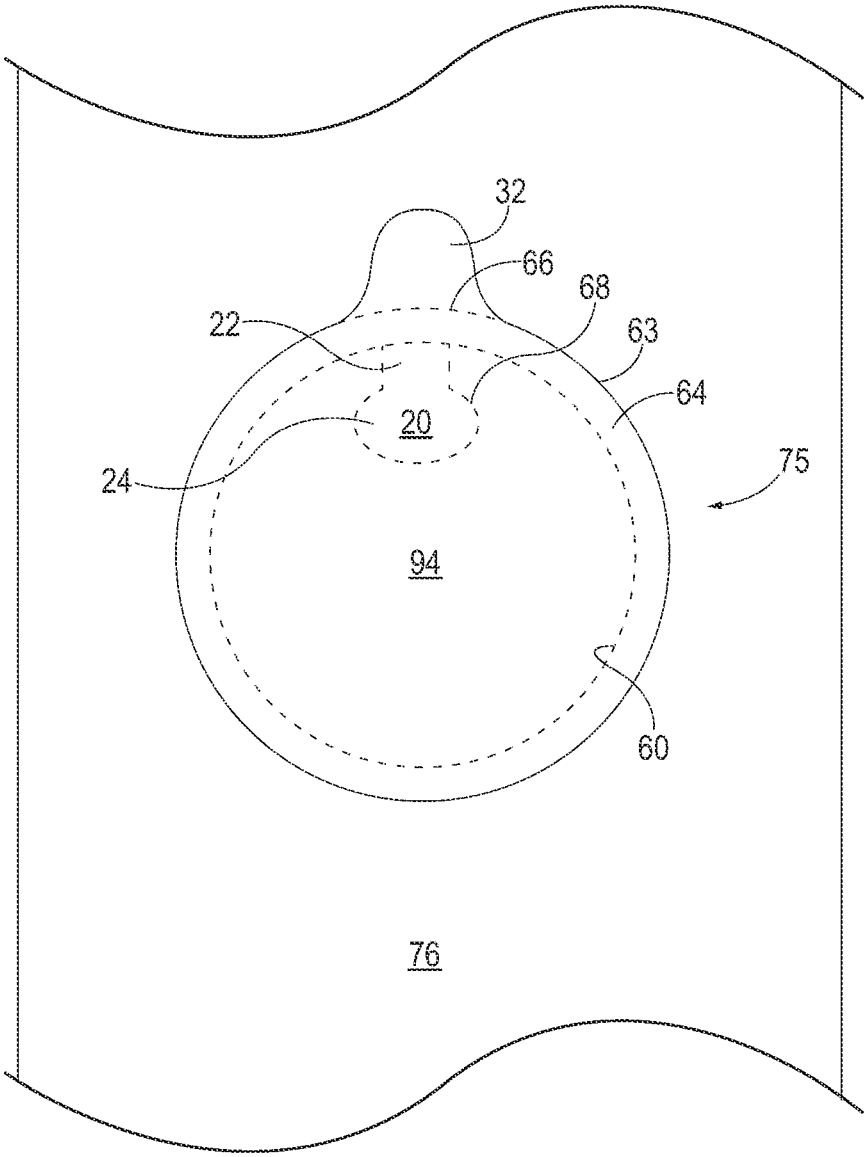
FIG. 3A illustrates a top view of a laminate sheet of the peelable portion of the lid, in accordance with an embodiment of the invention shown in FIGS. 5A-5C.

FIG. 3A illustrates a top view of a laminate of the peelable portion 75. First layer 76 is shown, with second layer 74 being disposed underneath layer 76 in the laminate view. Cut lines 60, 66, and 68 are depicted in broken lines, being undercut through the second layer 74, but not through first layer 76. As can be seen, cut line 66 separates the tab 32 from the remainder of the second layer 74. Cut line 60 defines the affixed portion 64, which remains affixed to the container structure upon peeling back of the peelable portion 75. Finally, cut line 68 is shown as intersecting cut line 60 to define the internal tab 20. FIG. 3A additionally illustrates cut line 63, which is cut through both the first layer 76 and the second layer 74 of the laminate, to define a perimeter of the lid 50. Cut line 63, in this embodiment, includes the first tab 32.

As noted above, in an embodiment, the pull tab 32 may be grasped by a user and used to peel the peelable portion 75 away from the container. In an embodiment, peeling back of pull tab 32 and peelable portion 75 may not grant the user access to the container contents 17 because removable portion 80 may remain affixed to the container rim 35, protecting the container contents 17 from exposure to the environment. Thus, pull tab 32 and peelable portion 75 can, in an embodiment, be removed in whole or in part without disturbing the contents 17 of the container 10.

Figure 3B:
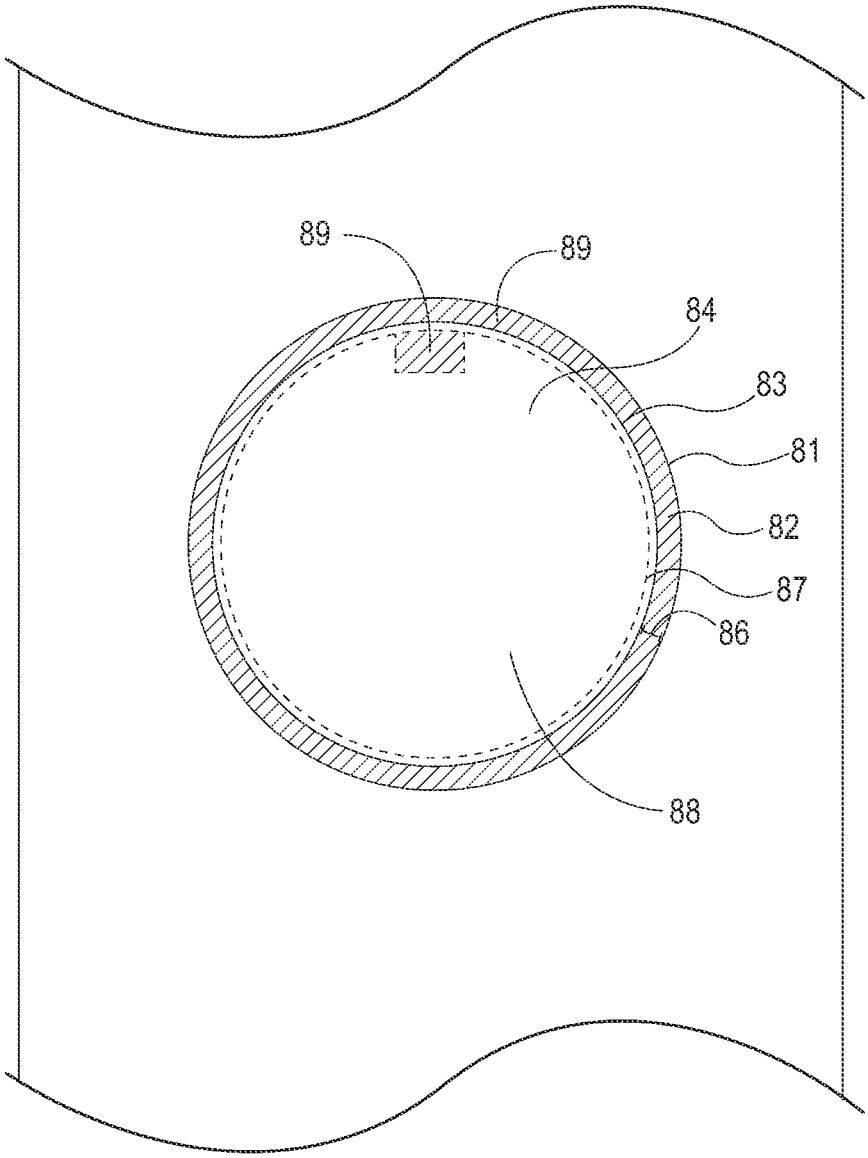
FIG. 3B illustrates a top view of a laminate sheet of the removable portion of the lid, in accordance with an embodiment of the invention.
Figure 4:
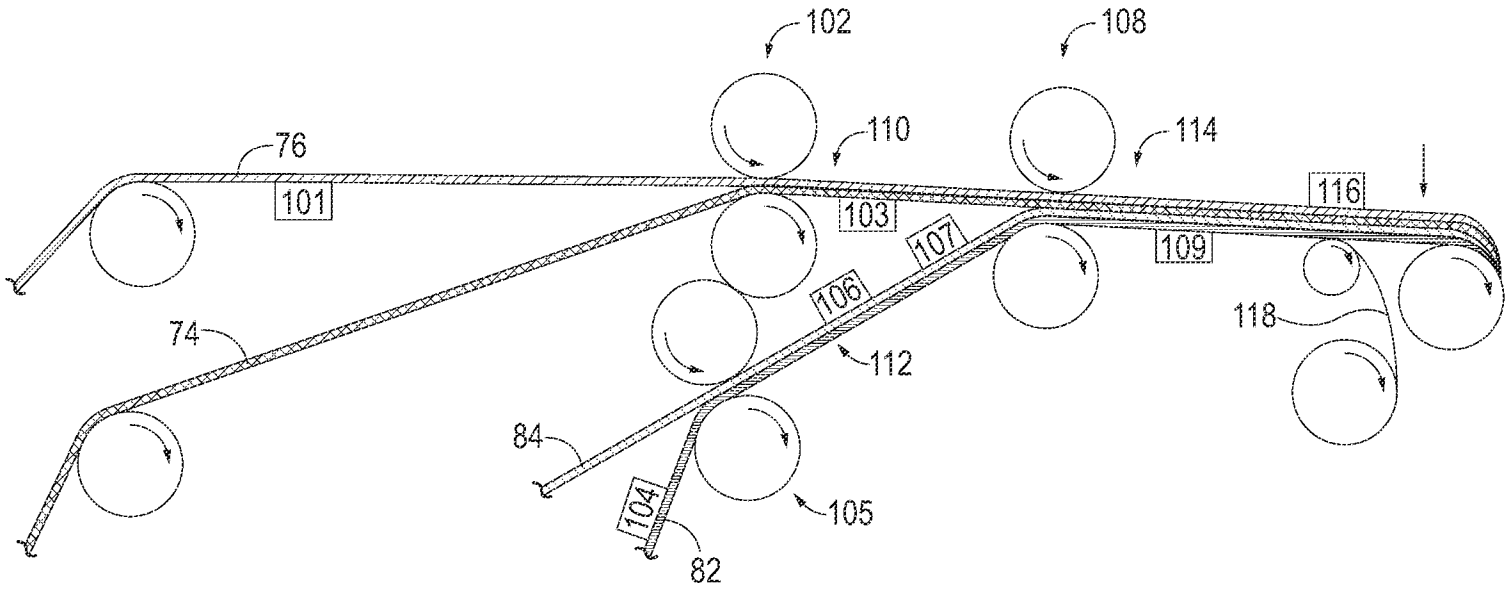
FIG. 4 is a diagram illustrating a method of making a membrane lid in connection with an embodiment of the present invention.

FIG. 3B illustrates a laminate of the removable portion 80. In an embodiment, shown in FIG. 2, the removable portion 80 may comprise one or more layers. In a particular embodiment, the removable portion 80 may comprise at least a sealant layer 82, such as Surlyn™, and a foil layer 84. There may or may not be an adhesive layer between the sealant layer 82 and the foil layer 84. In an embodiment, the foil layer 84 and the sealant layer 82 are coextruded. In yet another embodiment, the sealant layer 82 is a coating which is disposed or printed onto the foil layer 84. In any case, foil layer 84 and sealant layer 82 may be affixed to one another. In a particular embodiment, the upper surface of the sealant layer 82 is affixed to the lower surface of the foil layer 84 and the lower surface of the sealant layer 82 is configured to be sealed to the rim 35 of the container While layer 84 is described as a foil layer, it should be understood that layer 84 may be alternatively referred to as a removable upper layer 84 of the removable portion 80. In this embodiment, the removable upper layer 84 may comprise foil, paper, a polymer, or any combination of the same. In a particular embodiment, removable upper layer 84 comprises a barrier layer, providing a moisture and/or gas barrier between the interior of the container and the surrounding atmosphere.

Similarly, while sealant layer 82 is described as a sealant, the layer may be alternatively referred to as a removable lower layer 82 of the removable portion 80 and may comprise any material known in the art. In an exemplary embodiment, removable lower layer 82 may comprise a polymeric material and may be sealable to a separate polymeric material disposed on the rim 35 of the container or may be sealable to a polymeric container sidewall. Thus, removable lower layer 82 should not be limited to a sealant material. Likewise, however, the sealant layer 82 may comprise any sealant known in the art for adhering membrane lids to containers.

In an embodiment, each of the removable upper layer 84 and the removable lower layer 82 has an upper surface and a lower surface, with respect to the container. One or more additional layers may be present as part of removable portion 80. In an embodiment, the membrane lid 50 is heat sealed onto the rim 35 of the container. In an embodiment, the seal between the sealant layer 82 and the container rim 35 is a permanent heat seal.

In FIG. 3B, the sealant layer 82 is shown as having a greater diameter than that of the foil layer 84. In this embodiment, the foil layer 84 may be cut (see cut line 83) to a size which is slightly smaller than that of the sealant layer 82. In an embodiment, the foil layer 84 has a smaller diameter than that of the sealant layer 82. Cut line 83 may be top cut and disposed through only foil layer 84, in an embodiment. However, in an alternative embodiment shown in FIG. 6B, the sealant layer 82 is shown as having the same diameter as the foil layer 84. In this embodiment, cut line 83 does not exist.

Figure 6B:
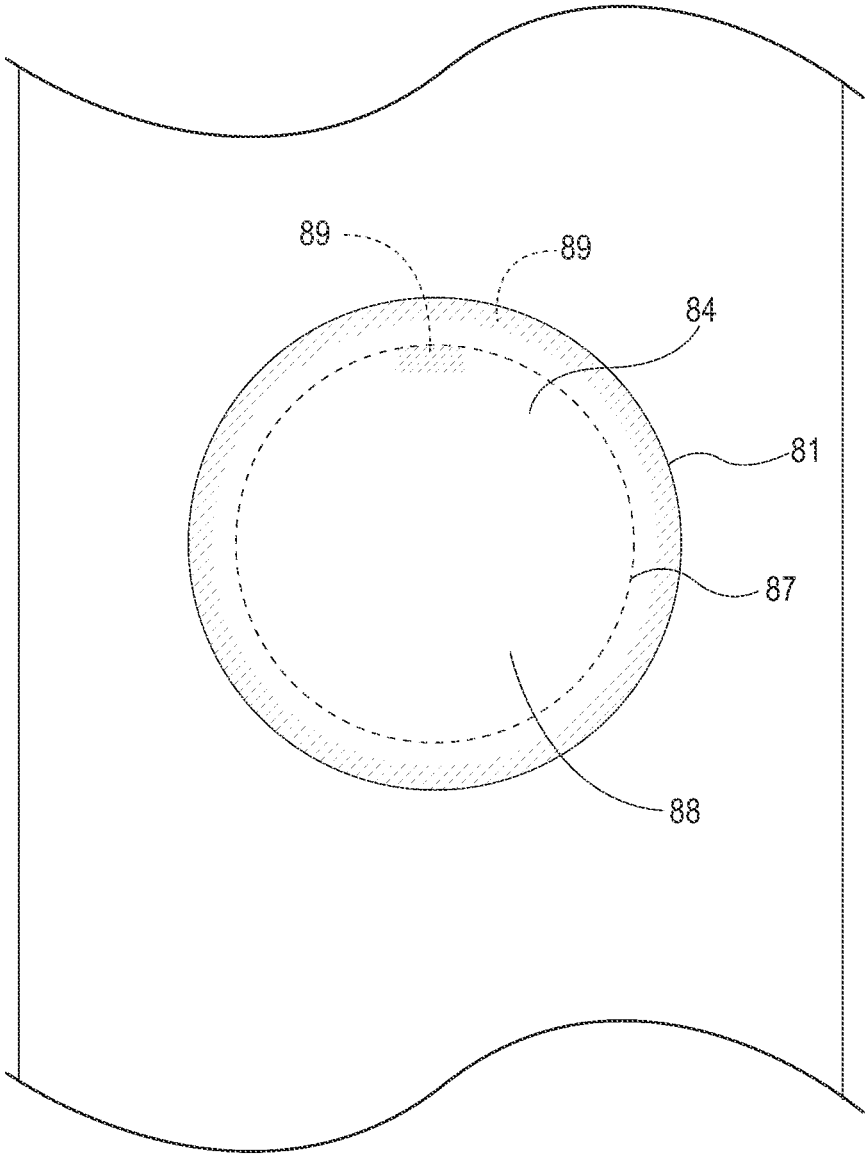
FIG. 6B illustrates a top view of a laminate sheet of the removable portion of the lid, in accordance with another embodiment of the invention.

Cut line 81, also shown in FIGS. 3B and 6B, may define the perimeter of the sealant layer 82 and, in some embodiments, foil layer 84. Cut line 81 may be disposed through both layers 82, 84, or may be disposed through only sealant layer 82, in an embodiment. In an embodiment, a peripheral region 86 of the sealant layer 82 extends circumferentially outwardly of the foil layer 84. Said another way, the peripheral region 86 may be the portion of the sealant layer 82 which is disposed between the perimeter of the foil layer 84 and the perimeter of the sealant layer 82. In an embodiment, the lower surface of the sealant layer 82 may be configured to align with, and be permanently sealed to, the rim 35 of the container in the position of the peripheral region 86.

In an embodiment, a fourth cut line 87 is undercut into the removable portion 80, at least partially, substantially or fully through the sealant layer 82, but preferably not into or through the foil layer 84. The fourth cut line 87 is shown in at least FIG. 3B. The fourth cut line 87 may be completely circumferential, such that the middle portion 88 of the sealant layer 82 may separate from the peripheral region 86 of the sealant layer 82 completely. In an embodiment, the fourth score line 87 may be disposed radially inward of the perimeter of the removable upper layer 84. In an embodiment, the fourth score line 87 may be disposed radially inward of the first cut line 60. In another embodiment, the fourth score line 87 may be disposed radially inward of the permanent adhesive 89 disposed in the peripheral region 86 of the removable lower layer 82. In an embodiment, the fourth score line 87 may be disposed radially inward of an inner edge of the rim 35 of the container. In an embodiment, the fourth score line 87 may be disposed adjacent an inner edge of the rim 35 of the container.

The cross-sectional view shown in FIG. 2C illustrates the separation of the middle portion 88 of the sealant layer 82 from the peripheral region 86 of the sealant layer 82. In this embodiment, when the second pull tab 20 is used to pull the removable portion away from the container, foil layer 84 will tear in a position above fourth cut line 87 and the sealant layer 82 will separate at cut line 87, such that the middle portion 88 of the removable portion 80 will be removed from the container structure and the peripheral region 86 will remain affixed to the container structure.

In an embodiment, a layer of permanent adhesive 89 is disposed along or within the peripheral region 86 of the sealant layer 82, on the upper surface of the sealant layer 82, adjacent the edge or perimeter of the foil layer 84. In another embodiment, a layer of permanent adhesive 89 is disposed along or within the peripheral region 86, but on the upper surface of the foil layer 84, between first cut line 60 and the perimeter of the lid 50. In an embodiment, the permanent adhesive 89 is disposed vertically above the rim 35 of the container. In this embodiment, the permanent adhesive may be any permanent adhesive known in the art. In an embodiment shown in FIG. 3B, because the foil layer 84 is circumferentially smaller than the sealant layer 82, the permanent adhesive 89 may be exposed prior to lamination of the peelable portion 75 to the removable portion 80.

In another embodiment, permanent adhesive 89 is disposed circumferentially on the lower surface of the lower peelable layer 74. In this embodiment, the permanent adhesive 89 may be disposed between the first cut line 60 and the edge of the lid 50. In this embodiment, the circumferential permanent adhesive 89 may be disposed below the affixed portion 64 of the peelable portion 75. In this embodiment, the circumferential permanent adhesive 89 may be substantially or fully circumferential. In this embodiment, the circumferential permanent adhesive 89 may align with the rim 35 of the container and/or the peripheral region 86 of the removable portion 80.

In an embodiment, permanent adhesive 89 is also disposed in a pattern-applied discrete location on the upper surface of the foil layer 84 and/or the lower surface of the lower peelable layer 74, corresponding to at least a portion of the second tab 20. In an embodiment, the permanent adhesive 89 is disposed in a location corresponding to the neck 22 of the second tab 20. The use of permanent adhesive in this manner serves to permanently adhere a portion of the second tab 20 to the removable portion 80, once the removable portion 80 and peelable portion 75 are laminated or adhered together.

Thus, in an embodiment, the peelable portion 75 is adhered to the removable portion 80, using the permanent adhesive 89, in the peripheral region 86/affixed portion 64 and in a location corresponding to at least a portion of the second tab 20. These regions of permanent adhesion serve to affix the peelable portion 75 to the removable portion 80 in the noted locations.

In an embodiment, the peelable portion 75 and the removable portion 80 are laminated together as shown in FIG. 2. As shown, the peelable portion 75 and the removable portion 80 may be permanently adhered along their perimeters, in the affixed portion 64 of the second layer 74 of the peelable portion 75, on the one hand, and the peripheral region 86 of the removable portion 80, on the other hand. Additionally, as described above, the peelable portion 75 and the removable portion 80 may be permanently adhered in the location of at least a portion of the second tab 20, allowing the second tab 20 to separate from the peelable portion 75 and remain affixed to removable portion 80 when the peelable portion 75 is peeled away from the container. In a particular embodiment, the permanent adhesive 89 disposed in the peripheral region 86 of the removable portion 80 adheres to the lower surface of the peelable lower layer 74, between the first score line 60 and the perimeter of the central portion of the peelable lower layer 74.

In an embodiment, once the peelable portion 75 is peeled away from the container, a void 77 may be visible on the lower surface of the peelable portion 75, which corresponds to the location of the removed second tab 20. In an embodiment, the void 77 may comprise a missing portion of peelable lower layer 74. The void 77 may or may not have PSA disposed therein. In an embodiment, the void 77 does not have PSA disposed therein and instead displays the lower surface of peelable upper layer 76.

In an embodiment, the interface between the peelable portion 75 and the removable portion 80 may be adhesive-free other than in the regions of the permanent adhesive as described herein, defining at least one adhesive-free region 95 (shown in FIG. 2A). That is, a portion of the interface between the removable portion 80 and the peelable portion 75 may be adhesive-free 95. In an embodiment, the central portion of the removable portion 80 and the peelable portion 75 may be substantially adhesive-free 95. In an embodiment, the central portion may comprise the area inside the first cut line 60, with the exception of the permanent adhesive applied to the portion of the second pull tab 20.

In an embodiment, the peelable membrane lid 50 may comprise an integrated peelable label, coupon, promotional piece, product information, or the like printed on one or both surfaces of the peelable portion 75 and/or the removable portion 80. For example, a consumer may peel back the peelable portion 75 to reveal a coupon, product information, dosing information, or nutritional information located on the underside of the peelable portion 75, the upper side of the removable portion 80, and/or the underside of the removable portion 80. In some embodiments, the outermost layer 76 may contain printing, graphics, or ink coloring.

In an embodiment, the body 15 may comprise at least one paperboard body ply, but in some cases, two (or more) plies of paperboard may be spirally wound to form the body 15. Recycled paperboard may, for example, be used in some applications. Moreover, in some cases, a label may be applied to an exterior of the at least one paperboard body ply, such as to provide markings indicating the type of product, brand, manufacturer, ingredients, etc. relating to the product held therein.

In an embodiment, a liner ply may be adhered to the inner surface of the paperboard body ply, via an adhesive. In some embodiments, the liner ply may be a multilayer liner structure that includes a paper layer, a low density polyethylene (LDPE) tie layer that holds one or more mOPP film layers to the paper layer, and a liner sealant disposed on an inner surface of the mOPP film layers. The paper layer may be adhered to the inner surface of the at least one paperboard body ply to affix the mOPP liner ply to the paperboard body ply. The mOPP liner ply and the paperboard body ply may be rolled together outwardly (e.g., with respect to the interior of the body 15) to form the rim 35 at the first end 16 of the body 15, as shown.

In some cases, an overcap may also be provided, where the overcap is configured to engage the first end 16 of the body 15 to cover the peelable membrane 50 before the membrane 50 is removed. The overcap may be, in an embodiment, replaceable onto the rim of the container after peeling of the peelable portion 75 and/or removal of the removable portion 80.

Method of Making

A method of manufacturing a container and membrane lid, as described herein, is also provided. Generally speaking, the method of manufacturing the membrane lid may comprise laminating the top layer 76 of the peelable portion 75 to the bottom layer 74 of the peelable portion, using at least a PSA. The lamination may occur before or after scoring of the bottom layer 74. In a particular embodiment, however, the layers 76, 74 are laminated together using flood-coated PSA and then the laminate peelable portion 75 is undercut. Lines 60, 66, and 68 may be undercut through the bottom layer 74, but preferably not into layer 76. In an embodiment, line 63, defining the perimeter of the lid 50, is not cut at this stage and peelable portion 75 remains in laminate sheet form.

More particularly, as shown in FIG. 6, a top layer 76 and a bottom layer 74 may be provided in sheet form. In an embodiment, an adhesive may be flood coated or pattern applied to the bottom surface of the top layer 76 in predetermined areas at station 101. In another embodiment, the adhesive is pattern applied to the top side of bottom layer 74. The adhesive(s) may be applied in any suitable patterns but, in an embodiment, at least the area between the layers 76, 74, in the position of the affixed portion 64, contains PSA. The adhesive may optionally be dried at a drying station such as an oven or the like.

Next, the top layer 76 and bottom layer 74 may be adhesively joined via the adhesives (station 102) to form a first laminate 110. This first laminate 110 will become the peelable portion 75 of the lid 50. Lamination may be accomplished using a laminating machine comprising two rollers forming a nip therebetween, or may be accomplished using any other method known in the art. In an embodiment, the top layer 76 and bottom layer 74 should be substantially coextensive with each other during the laminating process. For example, if the top layer 76 and bottom layer 74 are rectangular, the width and length of the top layer 76 should match the width and length of the bottom layer 74.

The first laminate 110 may then be undercut (optionally, precision undercut) at station 103 to form cut lines 60, 66, and 68 (shown in FIG. 3A), which extend through bottom layer 74, optionally into the PSA layer, but not into top layer 76.

Similarly, the foil layer 84 and the sealant layer 82 may be provided in sheet form. In an embodiment, an adhesive may be pattern applied to the bottom surface of the foil layer 84 or the top surface of the sealant layer 82, as shown at adhesive station 104. The adhesive may be flood coated or applied in any suitable pattern. The adhesives may optionally be dried at a drying station such as an oven or the like.

Next, the foil layer 84 and the sealant layer 82 may be adhesively joined via the adhesives (station 105) to form a second laminate 112. The second laminate 112 will become the removable portion 80 of the lid 50. Lamination may be accomplished using a laminating machine comprising two rollers forming a nip therebetween, or may be accomplished using any other method known in the art. In an embodiment, the foil layer 84 and the sealant layer 82 should be substantially coextensive with each other during the laminating process.

In another embodiment, optionally, the sealant layer 82 may be applied to the underside of the foil layer 84 as a coating or more particularly, as an extrusion coating. In this embodiment, laminating station 105 may be eliminated. In still another embodiment, the sealant layer 82 may be printed onto the underside of the foil layer 84 at a printing station. In these embodiments, the coated extrudate and/or print-coated foil layer 84 may be referred to as the second laminate 112.

In an embodiment, the second laminate 112 may then advance to a scoring station 106. In this embodiment, the second laminate 112 may be overscored to form cut line 83 in the foil layer 84. As with any scoring or cutting station discussed herein, the scoring may be precision scoring with a laser, in an embodiment. In an embodiment, the cut line 83 is cut through foil layer 84 without cutting into sealant layer 82. In a particular embodiment, this scoring step may be omitted, such that foil layer 84 is cut simultaneously with seal layer 82, at cut line 81, so that foil layer 84 and seal layer 82 have the same circumference.

In an embodiment, a permanent adhesive may then be pattern applied to the top surface of the second laminate 112, in predetermined areas, at station 107. In another embodiment, the permanent adhesive is pattern applied to the bottom side of the first laminate 110. The adhesive may be applied in any suitable pattern but, in an embodiment, is applied in at least the area between the laminates 110, 112 in the position of the affixed portion 64 and/or the peripheral portion 86. Likewise, at least a portion of the area between the laminates 110, 112 in the position of the second tab 20, contains permanent adhesive. The adhesive may optionally be dried at a drying station such as an oven or the like. In an embodiment, other than the in the location of the affixed portion 64 and/or the peripheral portion 86, and in the location of a portion of the second tab 20, the remainder of the interface between the first and second laminate 110, 112 remains adhesive-free.

Next, the first and second laminate 110, 112 may be adhesively joined via the permanent adhesive (station 108) to form a third laminate 114. Lamination may be accomplished using a laminating machine comprising two rollers forming a nip therebetween, or may be accomplished using any other method known in the art. In an embodiment, the first and second laminate 110, 112 are coextensive. In an embodiment, this third lamination step at station 108 is conducted in registration such that the undercut line 60 in the first laminate 110 aligns with the region of permanent adhesive applied to the second laminate 112. In this embodiment, the region of permanent adhesive applied to the second laminate 112 may be aligned radially outwardly of undercut line 60. Likewise, the registration should ensure that the permanent adhesive portion which is designed to align with the second pull tab 20 is aligned with at least a portion of the shape defined by undercut line 68.

Next, the third laminate 114 may proceed to a cutting station 109 wherein the sealant layer 82 may be undercut to form cut line 87, which does not extend into foil layer 84, in an embodiment. Also at cutting station 109, cut line 81 may be formed through sealant layer 82 and, optionally, foil layer 84, defining the perimeter of the removable portion 80. The cutting station may comprise a laser cutting station accomplished in registration with the cut lines and adhesive patterns already created.

In an embodiment, the perimeter of the peelable portion 75, also defining the perimeter of the membrane lid 50 (cut line 63) is cut at cutting station 116, through at least layers 76 and 74. Cut line 63 may include the tab 32. As set forth herein, scoring, cutting, and/or perforations may be accomplished via die-cutting, laser-cutting, water-cutting, kiss-cutting, or any other method known in the art. The skeleton 118 of the laminate may then be removed and discarded.

The above-noted steps need not occur in this particular order. For example, in some embodiments, the scoring may be accomplished before the adhesive application/lamination and may be applied in registry with the scoring. Additionally, while the lines are referred to herein as cut lines, score lines, and the like, it should be understood that perforations are also encompassed in the invention. Thus, any of the cut lines described herein may comprise a plurality of perforations. Likewise, the score lines or cut lines may comprise continuous cut lines. Unless otherwise specified, the score lines may extend partially or substantially through a layer or may extend fully through a layer. In the figures, the cut lines are shown as dashed lines when they are undercut and not viewable from the surface of the particular layer. Thus, the dashed lines need not be considered perforations.

In some embodiments, a tubular container body may be formed by spirally winding paperboard ply (e.g., a single ply, two plies, or more) and an optional liner ply, such as by spirally winding continuous strips of the materials around a mandrel of a desired shape (e.g., a cylindrical mandrel) to create the tubular structure. At the downstream end of the mandrel, the tubular structure may be cut into discrete lengths, and the body may be rolled outwardly to form the rim, as described above. The membrane 50, formed above, may then be affixed to the first end of the body 15 by sealing the sealant layer 82 to the rim 35. Optionally, each discrete section of the tubular body (representing a container) may be fitted with at least one end cap (e.g., at an end opposite to the first end 16 shown in FIG. 1), although in some applications the tubular bodies may be shipped to a separate facility for application of the end cap.

Although an example method of manufacturing a composite container according to embodiments of the invention is described above, it is understood that the steps of manufacturing the container may vary in some cases. For example, the order in which certain manufacturing steps occurs may vary, and/or in some cases certain steps may be omitted, and others may be added.

Method of Use

The method of use is illustrated in FIG. 1. When the user lifts tab 32, the cut line 66 allows the tab 32 to separate from the affixed portion 64 of the peelable portion 75. As the user peels back the tab 32, cut line 60 allows the central portion 94 of layer 74 to separate from the affixed portion 64. Further, cut line 68 allows the second tab 20 to separate from the remainder of the peelable portion 75 and instead remain affixed to removable portion 80 (due to permanent adhesive between second tab 20 and removable portion 80). The peelable portion 75 is peeled upwardly, toward the hinge 62. In an embodiment, at the location of the hinge 62, the peelable portion 75 cannot be peeled further or removed from the container. The lifting away of the peelable portion, in an embodiment, exposes the removable portion 80 but does not expose the container contents 17. In an embodiment, a hermetic seal may still exist at this stage of the opening process.

At this stage, if desired, a user may replace the peelable portion 75 onto the container rim 35. At least a portion of the PSA 72 which is disposed between the top layer 76 and the bottom layer 74 will be exposed due to separation of the affixed portion 64 from the remainder of the bottom layer 74. In an embodiment, at least the portion of the PSA 72 which is disposed between the top layer 76 and the bottom layer 74, and located above the affixed portion 64 will be exposed. Thus, if desired, a user may replace the peelable portion 75 onto the container rim 35 and the PSA 72 will engage with affixed portion 64 to create a reseal area. The peelable portion may be peeled away and resealed onto the affixed portion one or more times.

In an embodiment, lifting away of the peelable portion also exposes the second tab 20, which is permanently adhered to the foil layer 84 of the removable portion 80. In an embodiment, the second tab 20 may then be grasped and pulled. As the second tab 20 is pulled, the foil layer 84 may tear along a path substantially aligned with the fourth cut line 87. In another embodiment, the foil layer 84 was not otherwise affixed to the container body and lifts out of the structure with the sealant layer 82. In this embodiment, the cut line 87 allows the sealant layer 82 to separate from the container body. The removable portion 80 may then be fully removed and discarded, if desired.

As described above, at this stage, if desired, a user may replace the peelable portion 75 onto the container rim 35 and the PSA 72 will engage with affixed portion 64 to create a reseal area. The lower surface of removable portion 80, in the location of peripheral region 86, remains sealed to the rim 35 even after removal of the removable portion 80. The circumferential remnants of foil layer 84 and sealant layer 82, in the location of peripheral region 86, remain sealed to the rim 35 even after removal of the removable portion 80 in an embodiment. The lower surface of affixed portion 64 of the peelable portion 75 remains permanently adhered to the upper surface of removable portion 80, in the location of the peripheral portion 86. Thus, the peelable portion 75 may be peeled away and resealed onto the affixed portion 68 one or more times.

The accompanying figures are provided for explanatory purposes and may not show the different layers, plies, adhesives, labels, inks, and other components described above with respect to embodiments of the container. In addition, those components that are illustrated are not necessarily drawn to scale. Thus, certain layers that are shown as the same thickness or thinner than other layers may actually be thicker than other layers, and so on.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of manufacturing a flexible membrane lid for a container comprising:

providing a peelable upper layer and a peelable lower layer in sheet form;

applying a pressure sensitive adhesive to at least one of the peelable upper layer and the peelable lower layer;

laminating the peelable upper layer to the peelable lower layer to form a first web;

scoring the peelable lower layer of the first web to form a plurality of score lines comprising:

a first score line which is disposed interior of a perimeter of a central portion of the peelable portion, is at least partially circumferential, and defines a peripheral region between the first score line and an edge of the peelable portion, at least one second score line disposed at least partially along the perimeter of the central portion of the lid, and a third score line which forms a perimeter of a first pull tab;

pattern applying a permanent adhesive to the peelable lower layer within the peripheral region and within a portion of the perimeter of the first pull tab;

providing a removable upper layer and a removable lower layer which are affixed to form a second web;

laminating the peelable lower layer of the first web to the removable upper layer of the second web, via the permanent adhesive, to form a third web;

scoring the removable lower layer of the second web to define:

a perimeter of a removable portion of the lid, and a fourth score line which is disposed radially interior of first score line and is circumferential;

cutting the third web through at least the peelable upper layer and peelable lower layer to form a perimeter of the peelable portion of the lid, wherein the perimeter of the peelable portion of the lid includes a second pull tab which:

extends radially outwardly from a central portion of the lid, and is disposed adjacent the at least one second score line;

providing a container comprising a container body which comprises a bottom wall and at least one upwardly extending sidewall, wherein the at least one sidewall terminates in a rim and wherein the rim defines an open end of the container; and sealing the membrane lid to the rim of the container, over the open end.

2. The method of claim 1, wherein at least one of the peelable upper layer and the peelable lower layer is a flexible film.

3. The method of claim 1, wherein the removable upper layer is a foil layer.

4. The method of claim 1, wherein the removable lower layer is a sealant layer.

5. The method of claim 1, wherein after the sealing step, the first score line is disposed adjacent an inner edge of the rim of the container.

6. The method of claim 1, wherein after the sealing step, the fourth score line is disposed radially inward of an inner edge of the rim of the container.

7. The method of claim 1, wherein after the sealing step, the second score line is disposed adjacent an outer edge of the rim of the container.

8. The method of claim 1, wherein after the sealing step, the permanent adhesive disposed in the peripheral region is disposed vertically above the rim of the container.

* * * * *